United States Patent [19]

Lord et al.

[11] Patent Number: 4,974,475

[45] Date of Patent: Dec. 4, 1990

[54] CORDLESS POWERED RATCHET WRENCH

[75] Inventors: John M. Lord, Chicago; James S. Stanley, Willowbrook; Louis J. Vassos, Park Ridge, all of Ill.

[73] Assignee: Skil Corporation, Chicago, Ill.

[21] Appl. No.: 382,476

[22] Filed: Jul. 19, 1989

[51] Int. Cl.[5] ..... B25B 21/00

[52] U.S. Cl. ..... 81/57.13; 81/57.29; 81/60

[58] Field of Search ..... 81/57.13, 57.29, 60–63.2

[56] References Cited

U.S. PATENT DOCUMENTS

| | | | |
|---|---|---|---|
| 395,865 | 1/1889 | Abrams . | |
| 630,819 | 8/1899 | Sayers . | |
| 667,044 | 1/1901 | Thorsen . | |
| 878,657 | 2/1908 | Munch . | |
| 2,701,977 | 2/1955 | Stone . | |
| 3,290,969 | 12/1966 | Bergquist . | |
| 3,323,394 | 6/1967 | Bangerter . | |
| 3,436,992 | 4/1969 | Over et al. . | |
| 3,584,527 | 6/1971 | Bosten . | |
| 3,800,839 | 4/1974 | Bogle et al. . | |
| 3,905,429 | 9/1975 | Berger | 81/57.13 |
| 4,128,025 | 12/1978 | Main et al. . | |
| 4,289,049 | 9/1981 | Rebish . | |
| 4,472,985 | 9/1984 | Orikasa . | |
| 4,735,120 | 6/1988 | Beugelsdyk . | |
| 4,790,218 | 12/1988 | Cabrera | 81/57.13 |

FOREIGN PATENT DOCUMENTS

| | | | |
|---|---|---|---|
| 263348 | 2/1972 | United Kingdom | 81/57.13 |

*Primary Examiner*—James G. Smith

*Attorney, Agent, or Firm*—Jones, Day, Reavis & Pogue

[57] ABSTRACT

A cordless powered ratchet wrench includes a ratchet actuator that selects a direction of rotation of an output shaft that is adapted to hold rotating tools for use. The ratchet actuator also serves as a ratcheting stop to permit a limited amount of ratcheting motion for manual tightening or loosening of a nut, bolt or the like. A lost-motion drive transmits power from a battery to the output shaft while permitting nearly two full circles of ratcheting rotation. An external pushbutton operates internal switches to connect a rechargeable battery in a desired direction, and also functions as an interlock to prevent reversal of the direction in which torque is applied while the pushbutton is engaged. The ratchet actuator that selects a desired direction of rotation also functions to provide a positive driving surface for manual exertion of torque by an operator and as a ratchet to permit rotation in the opposite direction when the wrench is ratcheting, and it operates a switch to select a direction of powered motion. Exposed terminals prepare the wrench to be inserted into a charger for recharging the battery.

12 Claims, 5 Drawing Sheets

CORDLESS POWERED RATCHET WRENCH

BACKGROUND OF THE INVENTION

This invention relates to a cordless powered ratchet wrench. In particular, it is an improved battery-powered device for driving a shaft that can accept bits for wrenches, screwdrivers and the like, and that permits ratcheting action to assist an operator in tightening or loosening a threaded object manually to start or finish a job, the preponderance of which is performed under power from the battery. Exposed terminals on the powered cordless ratchet wrench make contact with matching terminals in a charger to permit the battery to be charged upon insertion of the powered cordless ratchet wrench into a charger.

The availability of economical battery cells that can be recharged repeatedly has led recently to the development of a number of battery-powered portable power tools. Such tools eliminate the hazards of electric shock to an operator in contrast to electric tools that are connected to the ac power line. They also add a dimension of convenience in that the user is not restricted to an extension cord or the location of an ac power outlet. The requirements for such a tool include a housing that is adequate to contain a rechargeable battery, means for recharging the battery, and means for reducing the relatively high rotational speed of the motor to a speed that is appropriate for operating the particular rotating tool that is selected. For most applications involving portable electric drills, which are typically constructed with a pistol grip and a trigger switch, all of the torque is normally applied from the motor, and the operator only applies a resisting torque to hold the drill in position. If the drill is to be used only for drilling holes, it is not necessary to reverse the direction of rotation, although this is a useful convenience in cordless electric drills that are also adapted to serve as power screwdrivers, and reversal can help to extract a drill bit from a drilled hole.

A cordless powered wrench, in contrast, has different requirements. It is designed primarily for inserting and removing nuts, bolts, cap screws and the like. A cordless powered wrench, therefore, must be capable of some form of reversal of operation to allow nuts and bolts to be screwed or unscrewed and to allow for the possibility of operation of nuts or bolts having left-handed threads. In addition, typical operation of a wrench of any kind calls for a higher value of torque upon starting to unscrew a nut or bolt or upon finally tightening a nut or bolt. This is effectively accomplished by combining the cordless wrench with a ratchet feature that permits an operator to use the cordless wrench as a manually powered ratchet wrench to start or seat nuts and bolts. An example of such a ratchet is shown in U.S. Pat. No. 2,701,977, entitled "Reversible Ratchet Wrench," which is incorporated here by reference as if set forth fully. The '977 patent teaches a plunger containing steps that serve as teeth to drive the wrench in one direction and as ratcheting teeth that permit the wrench to turn freely in the other direction. The directions are reversed by sliding the plunger.

A powered wrench is difficult and expensive to construct if it is driven through a ratchet. However, at least a limited amount of ratcheting action makes a power tool much more useful than one that lacks ratcheting. A ratcheting feature allows the operator to turn a nut or bolt through a substantial range of rotation by operating the tool repeatedly back and forth through a more limited range of rotation. However, the use of a full ratchet in a cordless wrench represents a source of manufacturing complications, unreliability of the tool, and often excessive noise of operation.

SUMMARY OF THE INVENTION

It is an object of the present invention to provide an improved cordless wrench that includes ratcheting action.

It is a further object of the present invention to provide a cordless ratchet wrench which functions as a manually operated ratchet wrench over a limited range of rotation and which is driven electrically through a mechanism other than the ratchet mechanism.

It is a further object of the present invention to provide a cordless ratchet wrench in which a single external selector switch selects a direction of motor rotation and also selects an appropriate ratcheting direction.

It is a further object of the present invention to Provide a cordless wrench with limited ratcheting for manual operation in which electric power is transmitted to a rotating shaft by a lost-motion linkage.

Other objects will become apparent in the course of a detailed description of the invention.

A cordless powered ratchet wrench includes a selector switch that selects a direction of rotation of an output shaft that is adapted to hold rotating tools for use. The selector switch also serves as a ratcheting stop to permit a limited amount of ratcheting motion for manual tightening or loosening of a nut, bolt or the like. A lost-motion drive transmits power from a battery to the output shaft while permitting nearly two full circles of ratcheting rotation. An external pushbutton operates internal contacts to connect a rechargeable battery in a desired direction, and also functions as an interlock to prevent reversal of the direction in which torque is applied while the pushbutton is engaged. The selector switch that selects a desired direction of rotation also functions to provide a positive driving surface for manual exertion of torque by an operator and as a ratchet to permit rotation in the opposite direction when the wrench is ratcheting. Exposed terminals prepare the wrench to be inserted into a charger for recharging the battery.

DETAILED DESCRIPTION OF THE INVENTION

Figures 1, 6:
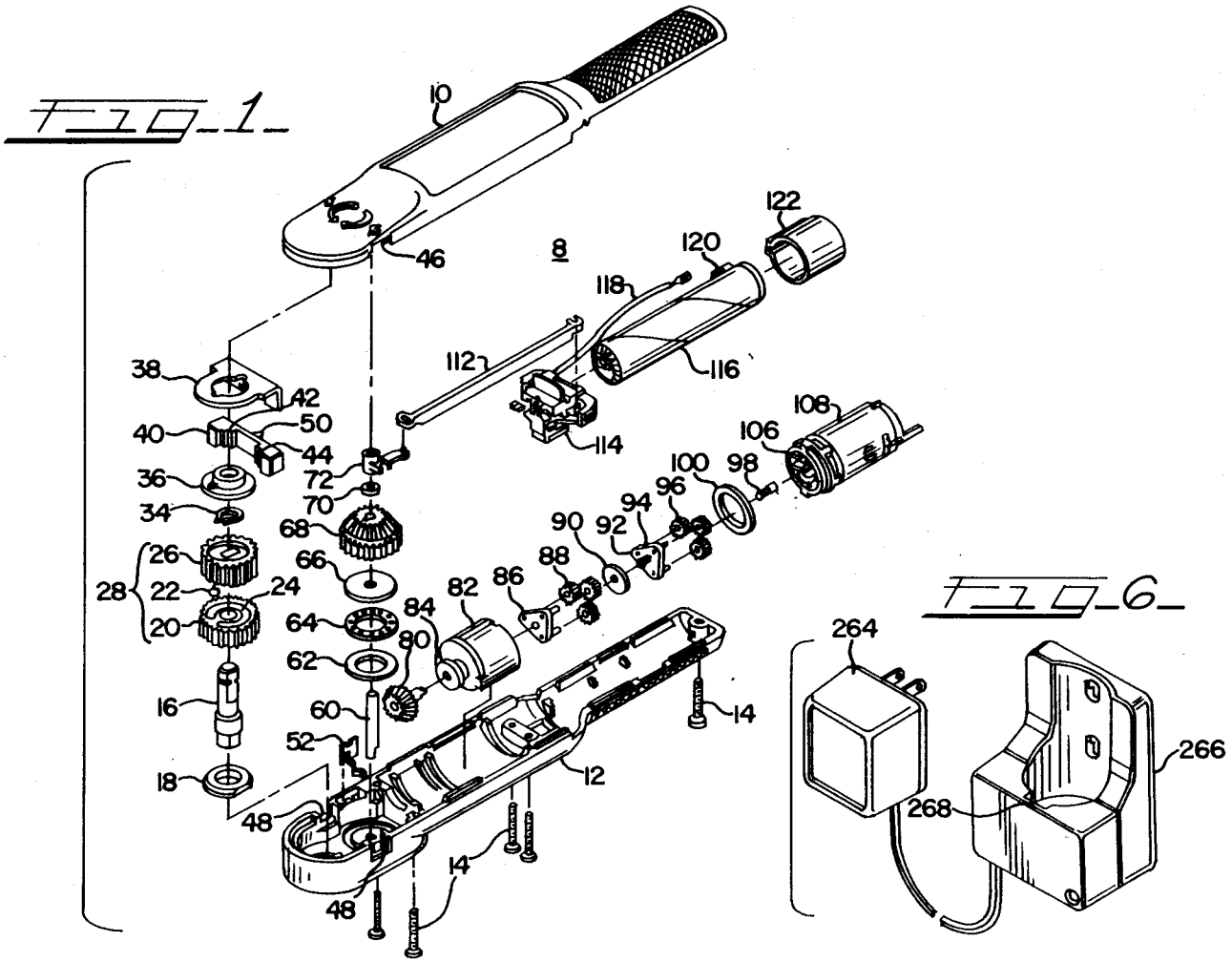
FIG. 1 is an exploded isometric view of the cordless ratchet wrench of the present invention.
FIG. 6 is a perspective view of a charger for the cordless ratchet wrench of the present invention.

FIG. 1 is an exploded perspective view of the cordless ratchet wrench 8 of the present invention. In FIG. 1, an upper housing 10 is joined to a lower housing 12 by screws 14 when the cordless ratchet wrench 8 is assembled. An output shaft assembly 16 rotates on a driver bearing 18 that is set in the lower housing 12. A driver gear 20 is free to rotate on the output shaft assembly 16. The driver gear 20 is driven by a ball 22 which is captured in a circumferential slot 24 of the driver gear 20. A ratchet wheel 26 has a corresponding circumferential slot that is not shown in FIG. 1. The circumferential slot 24 in the driver gear 20 and the corresponding slot in the ratchet wheel 26 capture the ball 22 and, together with the ball 22, form a lost-motion drive 28. The term "lost-motion" describes the fact that the ratchet wheel 26 can rotate approximately 1¾ turns with respect to the driver gear 20 as the ball 22 is rolled from one end of the circumferential slot 24 and its counterpart in the ratchet wheel 26 before reaching one or the other of the extremities of the circumferential slot 24.

The ratchet wheel 26 is keyed to the output shaft assembly 16. Power to turn the output shaft assembly 16 is transmitted from the driver gear 20 through the ball 22 to the ratchet wheel 26. A retaining ring 34 locks the lost-motion drive 28 in place on the output shaft assembly 16. An upper bearing 36 is held in place by a ratchet bracket 38 to withstand axial thrust from the ratchet wheel 26. A ratchet actuator 40 is shown for clarity in an open space of FIG. 1. When in position, the ratchet actuator 40 is disposed so that its steps 42 engage the ratchet wheel 26 in one direction of rotation and its steps 44 engage the ratchet wheel 26 in the other. The ratchet actuator 40 projects from the slots 46 in the upper housing 10 and the slots 48 in the lower housing 12. A detent 50 projects from the side of the ratchet actuator 40 that is opposite to the steps 42 and 44. A ratchet spring 52 is disposed in the lower housing 12 to engage the detent 50 of the ratchet actuator 40 in the assembled cordless ratchet wrench 8 of the present invention.

Power transmission in the cordless ratchet continues through a shaft 60 which is supported between the upper housing 10 and the lower housing 12. A bearing washer 62 supports a bearing 64. The bearing washer 62 is supported in a groove in the lower housing 12 so as to be concentric with the access of the shaft 60. A flat washer 66 is free to rotate about the shaft 60 on the bearing 64. A bevel gear 68 engages the flat washer 66 to rotate about the shaft 60. When the cordless ratchet wrench 8 is assembled, the bevel gear 68, which is also formed as a spur gear, engages the driver gear 20 to drive the output shaft assembly 16. A flat washer 70 and a switch actuator 72 complete the components that are on the shaft 60. The switch actuator 72 is operated by the detent 50 in the ratchet actuator 40, which will be seen to select a direction of rotation of a motor at the same that it selects an allowed direction of ratcheting of the output shaft 16.

In FIG. 1, a pinion assembly 80 is supported in a ring-gear bearing assembly 82. A sleeve bearing 84 exerts thrust against the pinion assembly 80 to hold it in a driving position against the bevel gear 68. The ring-gear bearing assembly 82 includes a second carrier assembly 86 that contains three planet gears 88 and is keyed to drive the pinion assembly 80. A flat washer 90 is placed on a sun gear 92 of a first carrier assembly 94. The sun gear 92 rotates with the first carrier assembly 94 to drive the planet gears 88. Planet gears 96 are in planetary position on the first carrier assembly 94 and are driven by a sun gear 98. The first carrier assembly 94, together with the planet gears 96 and the sun gear 98, comprises a high-speed low-torque reducer in comparison with the combination of the second carrier assembly 86 and planet gears 88, which by comparison represent a high-torque low-speed reducer. A flat washer 100 completes the ring-gear bearing assembly 82.

A motor mounting plate 106 is attached to a motor 108 by screws that are not shown in FIG. 1. The ring-gear bearing assembly 82 fits into the motor mounting plate 106, and the sun gear 98 is driven by the motor 108.

FIG. 1 also shows a bar strap 112 which connects the switch actuator 72 to a switch assembly 114. The bar strap 112 is sized and located so as to extend beyond the motor 108 when the tool is assembled, and the switch 114 is assembled in line with the motor 108 to connect a battery 116 to the motor 108. A wire 118 connects the switch 114 to a terminal 120 of the battery 116. A battery boot 122, made of an insulating material, surrounds a portion of the battery 116, including the terminal 120, so as to insulate the terminal 120 from electrical contact with the upper housing 10 or the lower housing 12.

Figure 2:
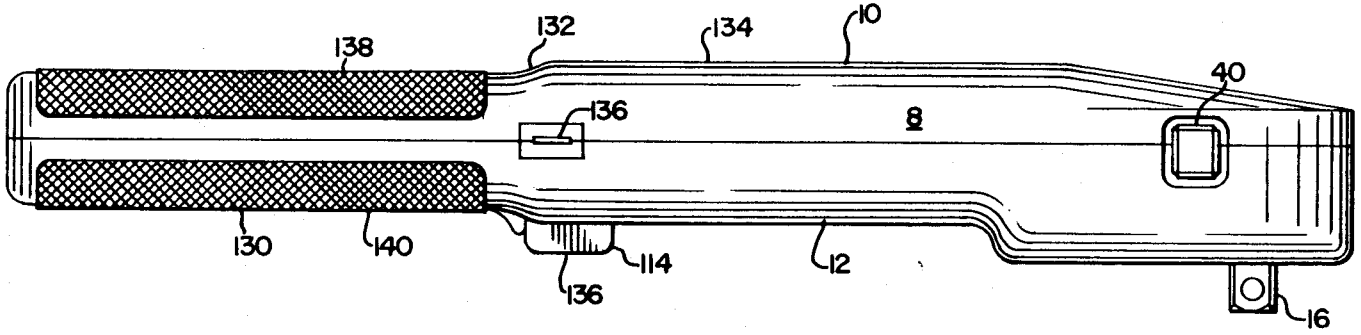
FIG. 2 is a side view of the cordless ratchet wrench of the present invention.
Figure 3:
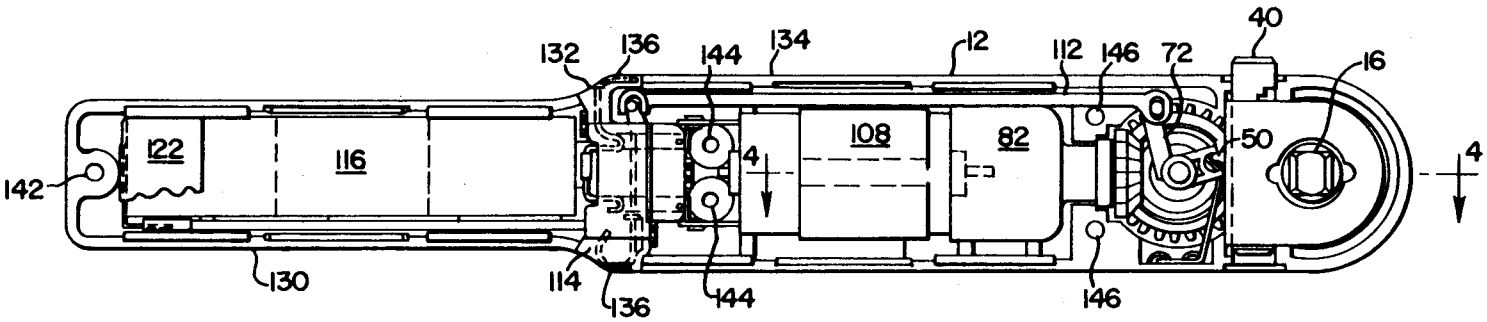
FIG. 3 is a top view of the cordless ratchet wrench of the present invention with the upper housing removed.

FIG. 2 is a side view of the cordless ratchet wrench 8 of the present invention, and FIG. 3 is a top view of the cordless ratchet wrench 8 with the upper housing 10 removed. In FIGS. 2 and 3 a handle 130 is formed by that part of the assembled upper housing 10 and lower housing 12 that contains the battery 116 and the battery boot 122. A shoulder 132 connects the handle 130 to a body 134 which contains the motor 108 and the ring-gear bearing assembly 82. The switch assembly 114 is located at the shoulder 132. It includes a pair of charging contacts 136 that will be seen to make contact with a charger to charge the battery 116. The switch assembly 114 also includes a pushbutton 136 that is visible in FIG. 2. The output shaft assembly 16 is visible from the side in FIG. 2 and from the top in FIG. 3. The ratchet actuator 40 is shown in FIG. 3 in the left-handed position as viewed from the top of the portable ratchet wrench 8. In this position, the detent 50 has rotated the switch actuator 72 in a counterclockwise direction as viewed from the top, moving the bar strap 112 in the direction of the handle 130. Depressing the ratchet actuator 40 would shift it to cause it to project from the right side of the body 134, which is toward the bottom as seen in FIG. 3. This would move the bar strap 112 in the direction away from the handle 130. FIG. 2 also shows knurling 138 in upper housing 10 and knurling 140 in lower housing 12. This provides a secure grip for an operator who is using the cordless portable wrench 8. It should be evident that other forms of grip material such as plastic grips and the like could equally as well be used.

FIG. 3 also shows a clearance hole 142 near the end of the handle 130. Two clearance holes 144 are located near the shoulder 132 and two clearance holes 146 are located in the body 134 towards the end that includes the shaft assembly 12. The screws 14 of FIG. 1 are passed through the clearance holes 142, 144 and 146 into matching threaded holes in the upper housing 10. These threaded holes are not visible in FIG. 2. The screws 14 of FIG. 1 secure the lower housing 12 to the upper housing 10 as shown in FIG. 2.

Figure 4:
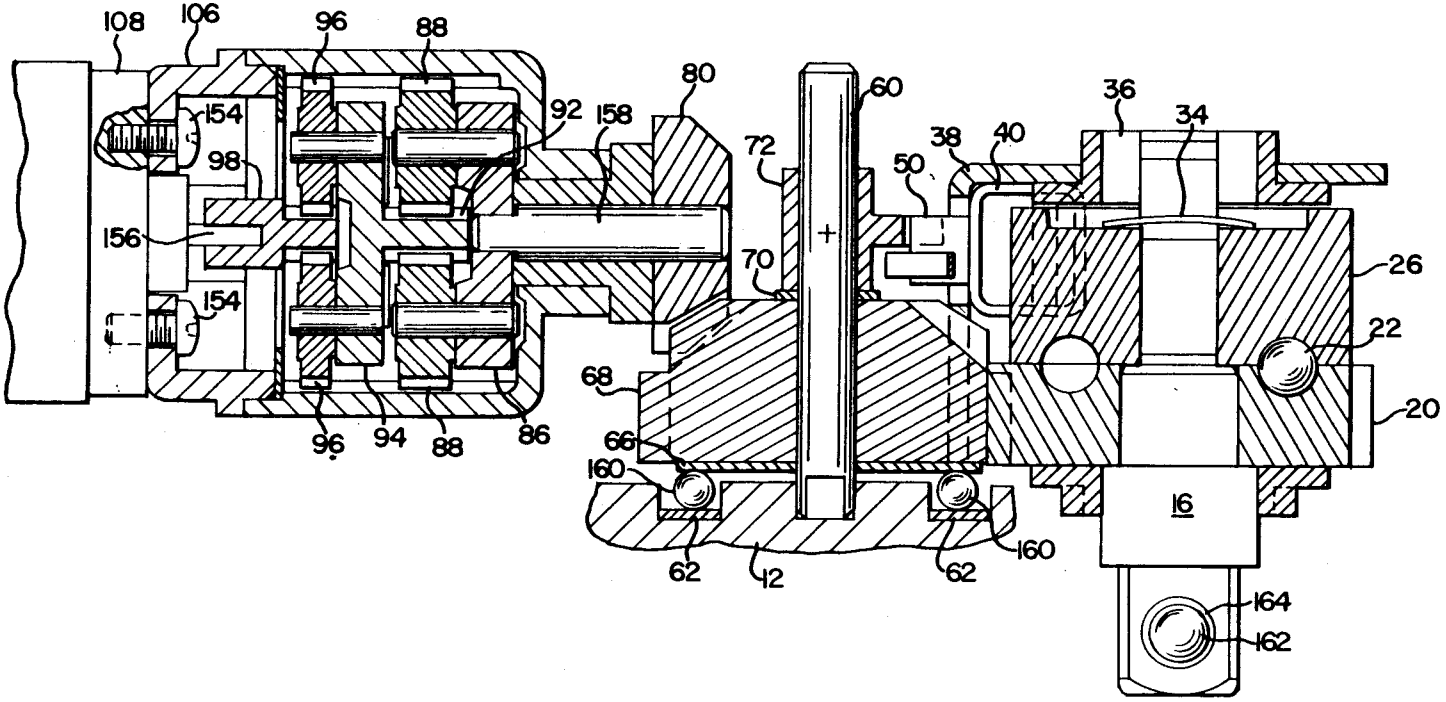
FIG. 4 is a sectional side view of a portion of the cordless ratchet wrench of the present invention taken along section lines 4—4 of FIG. 3.

FIG. 4 is a sectional side view of a portion of the cordless ratchet of the cordless ratchet wrench 8 of the present invention, taken along section lines 4—4 of FIG. 3. In FIG. 4, the motor mounting plate 106 is secured to the motor 108 by a pair of mounting screws 154. A motor shaft 156 engages and drives the sun gear 98 which in turn engages and drives the planet gears 96. The first carrier assembly 94 includes the sun gear 92 that drives the planet gears 88 and thus the second carrier assembly 86. The second carrier assembly 86 in turn drives a shaft 158 that is part of the pinion assembly 80. The result of the interconnections just described is to rotate the pinion assembly 80 in the direction of rotation of the motor shaft 156 at a rotation rate that is reduced by a factor of 81 in the preferred embodiment. The rotation of the pinion assembly 80 is also coaxial with that of the motor shaft 156.

The shaft 60 of FIG. 4 is substantially perpendicular to the axis of the pinion assembly 80. The shaft 60 is keyed into the lower housing 12 which is also grooved to receive the bearing washer 62 and the balls 160 of the bearing 64. The flat washer 66 rotates on the balls 160 to allow ready rotation of the bevel gear 68. The bevel gear 68 includes a beveled portion that meshes with the pinion assembly 80 and a spur-gear portion that meshes with the driver gear 20. In the preferred embodiment, the bevel gear 68 was made of powdered metal that was pressed and sintered to form a single component. This is a matter of design choice in manufacture.

The flat washer 70 separates the bevel gear 68 from the switch actuator 72 which is on the shaft 60 and rotates about the shaft 60 on the flat washer 70, rotated by the detent 50 in the ratchet actuator 40. The ratchet bracket 38 supports the ratchet actuator 40 and also the upper bearing 36. The retaining ring 34 locks the ratchet wheel 26 and the driver gear 20 on the output shaft assembly 16. The ball 22 provides the lost-motion drive between the ratchet wheel 26 and the driver gear 20 that was described above. A ball 162 is staked by a ring 164 against a spring which is not shown to provide means for retaining a tool on the output shaft assembly 16.

Figure 5:
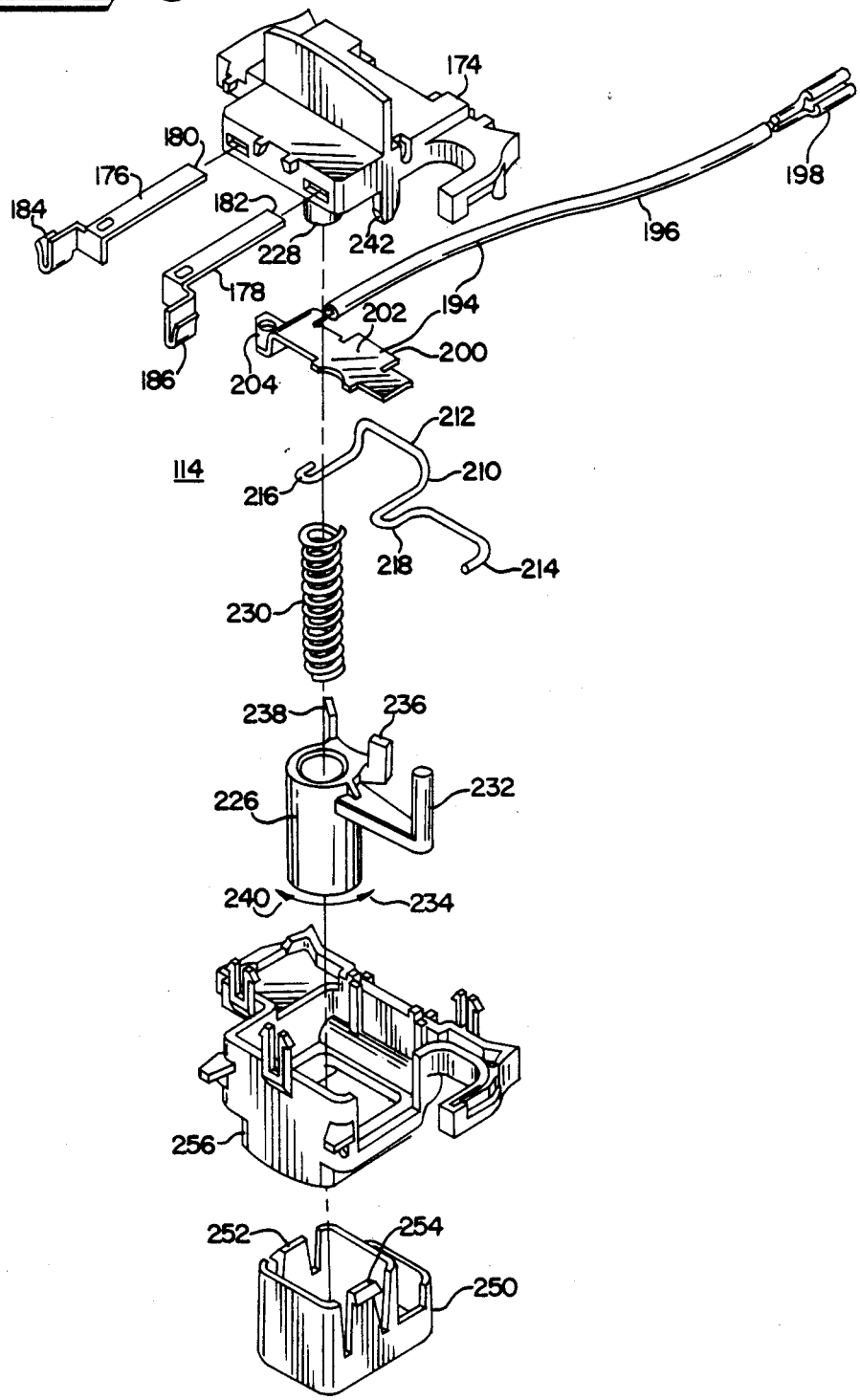
FIG. 5 is an exploded view of the switch assembly of the cordless ratchet wrench of the present invention.

FIG. 5 is an exploded view of the switch assembly 114 of FIG. 1. In FIG. 5, an upper housing 174 is slotted to receive a first motor switch contact 176 and a second motor switch contact 178. The motor switch contacts 176 and 178 have cantilevered portions 180 and 182 respectively. The cantilevered portions 180 and 182 extend into the upper housing 174. A negative terminal contact 194 includes a wire 196 that connects a battery connector 198 to a connector plate 200. The connector plate 200 includes a contact surface 202 and a charger contact 204. When the negative terminal contact 194 and the switch contacts 176 and 178 are assembled in the upper housing 174, the cantilevered portions 180 and 182 of the contacts 176 and 178 are normally held by their own elastic force against the positive contacts 216 and 218 respectively of a positive terminal contact 210. The positive terminal contact 210 is inserted in the upper housing 174 to perform several functions. First, a battery contact 212 projects from the upper housing 174 to make electrical contact with a positive center terminal (not shown) of the battery 116 of FIG. 1. Second, a positive charger terminal 214 projects from the upper housing 174 to allow an external electrical contact with a battery charger to the positive terminal of the battery 116. Finally, the two positive contacts 216 and 218 are disposed below and in contact with the cantilevered portions 180 and 182 respectively so that one or the other of the cantilevered portions 180 and 182 can be pressed out of electrical contact with the positive contacts 216 and 218 and into electrical contact with the contact surface 202 to apply power in one direction or the other to the motor 108, which is connected to the terminals 184 and 186 of the motor switch contacts 176 and 178.

The mechanism for pressing one or the other of the cantilevered portions 180 and 182 is as follows. A reversing crank 226 rotates on a shaft 228 that is part of the upper housing 174. A coil spring 230 provides a spring force that tends to move the reversing crank 226 away from the upper housing 174. The reversing crank 226 is rotated on the shaft 228 by the bar strap 112 of FIGS. 1 and 3, which is connected to the arm 232 of the reversing crank 226. When the reversing crank 226 is rotated in the direction of an arrowhead 234, a projection 236 of the reversing crank 226 is rotated toward the center line of the housing 174 and a projection 238 is rotated so that it will move the cantilevered portion 180 into contact with the contact surface 202 and out of contact with the positive contact 216 when a pushbutton 250 is pressed to drive the motor 108 in one direction. When the reversing crank 226 is rotated in the direction of an arrowhead 240, the cantilevered portion 180 stays in contact with the common contact terminal 218 while the cantilevered portion 178 is moved by the projection 236 into electrical contact with the contact surface 202 and out of contact with the positive contact 218 when the pushbutton 250 is pressed to drive the motor 108 in the opposite direction. A detent 242 in the upper housing 174 keeps the reversing crank 226 from being rotated on the shaft 228 when it is pressing one of the cantilevered portions 180 and 182.

A pushbutton 250 includes a pair of latches 252 and 254 that hold the pushbutton 250 in place in a lower housing 256. When the lower housing 256 is then snapped into the upper housing 174 to complete the switch assembly 114, the coil spring 230 exerts a force that causes the pushbutton 250 to project from the switch assembly 114. In this position, both terminals of the motor 108 are connected to the positive terminal of the battery 116 and the reversing crank 226 can be rotated on the shaft 228. When the pushbutton 250 is pressed, the reversing crank 226 is moved along the shaft 228 against the force of the coil spring 230 to apply power to the motor 108 to rotate it in the direction chosen by moving one or the other of the cantilevered portions 180 and 182 out of contact with the contact 216 or 218 and into contact with the contact surface 202 of the negative terminal contact 194.

FIG. 6 is a perspective view of a battery charger for the practice of the present invention. In FIG. 6, a transformer 264 supplies a stepped-down ac voltage to a housing 266 that is sized to fit the cordless ratchet wrench 8 in only one way. The ac voltage is rectified in the housing 266. The pushbutton 250 of FIG. 5 serves as a key to fit in a keyway 268 in FIG. 6 to assure insertion of the cordless ratchet wrench 8 with exposed terminals of the proper polarity. Electrical contacts that are not shown here engage the positive charger terminal 214 and the negative charger contact 204 of FIG. 5 to allow the battery 116 of FIG. 1 to be charging when the wrench is not in use.

Figure 7:
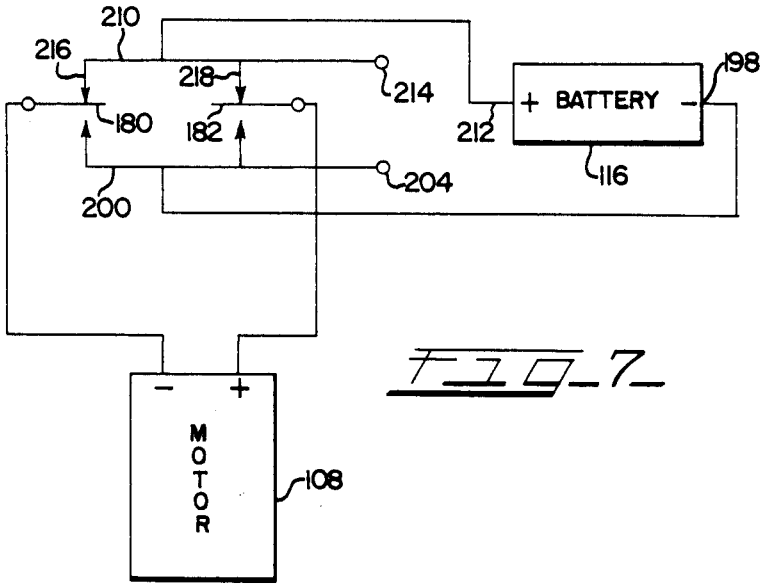
FIG. 7 is a circuit diagram of the electrical connections within the cordless ratchet wrench of the present invention.

FIG. 7 is a circuit diagram of the electrical connections of the present invention. In FIG. 7, the motor 108 is connected to the cantilevered portions 180 and 182, which are spring-biased to connect to the positive terminal contact 210 at the positive contacts 216 and 218 respectively. The positive terminal contact 210 is connected to the positive terminal of the battery 116 at the contact 212. The connector plate 200 makes contact with one or the other of the cantilevered portions 180 or 182 as described above with reference to FIG. 5. The connector plate 200 is connected to the negative terminal of the battery 116 at the battery connector 198 to complete an electrical circuit when one of the cantilevered portions 180 or 182 is switched. The negative charger terminal 204 and the positive charger terminal 214 are always connected to the battery connector 198 and the battery contact 212 respectively without passing through any switches. Inserting the cordless ratchet wrench 8 into the housing 266 is all that is needed to make a charging connection to the housing 266.

In an embodiment of the present invention that has been built and tested, the housings 10 and 12 were die-cast aluminum. All of the gears were made of powdered metal that was pressed to shape and sintered except for the planetary gears 96, which were made of an engineering polymer sold under the trademark Delrin. The carrier assemblies 86 and 94 were made of sintered powdered metal with inserted steel shafts. The ball 22 was a hardened steel ball of the type commercially available for use in ball bearings. The upper switch housing 174, the lower housing 256 and the reversing crank 226 were made of an engineering polymer. The switch contacts 176 and 178 were made of phosphor bronze, and the pushbutton 250 was nylon. These represent choices of materials that were used in the preferred embodiment of the invention. Their mention here in connection with the description of that embodiment, and the description itself, should be taken as illustrative and not as limiting, and the scope of the invention is that of the appended claims.

We claim:

1. A cordless ratchet wrench comprising:

(a) a housing including a handle and a body;

(b) a rechargeable electric battery disposed in the housing;

(c) an electric motor disposed in the housing;

(d) a reversing switch connected to the electric motor and to the rechargeable electric battery to allow operation of the motor in alternate directions of rotation;

(e) an output shaft adapted to hold and operate rotatable tools;

(f) a lost-motion device connected to the electric motor and driven by the electric motor and also connected to the output shaft to drive the output shaft; and (g) a ratchet mechanism connected to the lost-motion device to permit ratcheting action during operation of the lost-motion device and also connected to the reversing switch controlled by operation of the reversing switch.

2. The apparatus of claim 1 comprising in addition:

(a) a set of reducing gears connected to the motor to rotate a first bevel gear at a rotational speed that is proportional to a rotational speed of the motor; and (b) a second bevel gear including a coaxial spur gear, the second bevel gear operatively connected to the first bevel gear to produce rotation about an axis that is substantially perpendicular to an axis of the first bevel gear and to the lost-motion device to rotate the lost-motion device.

3. The apparatus of claim 1 wherein the lost-motion device comprises in addition:

(a) a first gear having a top edge and a bottom edge opposite the top edge, the first gear having a centrally disposed keyed slot of a predetermined size extending through the first gear, the first gear having teeth located about its outer peripheral circumference, the teeth extending from the top edge to the bottom edge, the first gear having a recessed top surface and a bottom surface centrally disposed about the slot and substantially parallel to each other, the first gear having a circumferential groove of a predetermined size recessed in its bottom surface extending substantially, but not entirely, about the circumference of the first gear;

(b) a second gear having a top edge and a bottom edge opposite the top edge, the second gear having a centrally disposed aperture of a predetermined size extending through the second gear, the second gear having teeth located about its outer peripheral circumference, the teeth extending from the top edge to the bottom edge, the second gear having a circumferential groove sized to match the circumferential groove in the first gear recessed in its top surface and extending substantially, but not entirely, about the circumference of the second gear; and (c) a ball of a predetermined size and sized to roll freely within the circumferential groove, the ball disposed between the first gear and the second gear.

4. The apparatus of claim 3 wherein the first gear is a ratchet wheel of a predetermined size and substantially circular in shape.

5. The apparatus of claim 3 wherein the second gear is a driver gear of a predetermined size and substantially circular in shape.

6. The apparatus of claim 1 wherein the ratchet mechanism comprises in combination:

(a) a substantially circular bearing having a centrally disposed aperture of a predetermined size extending through the bearing, the bearing having a centrally disposed substantially circular shoulder about the aperture and extending away from the shoulder for a predetermined distance;

(b) a ratchet actuator having a detent extending a predetermined distance from the ratchet actuator and centrally disposed along one side of the ratchet actuator, the ratchet actuator further having a plurality of substantially symmetrical recessed shoulders of a predetermined size extending in steps toward the detent and terminating in substantially the same plane and separated by a predetermined distance;

(c) a bracket having a first edge, the bracket having a centrally disposed aperture of a predetermined size and adapted to retain the ratchet actuator in proper alignment along the wall within the housing during operation of the ratchet actuator; and (d) a spring disposed in the housing at a predetermined location and fitted to contact and bias the ratchet actuator in a predetermined direction during the operation of the ratchet actuator.

7. The apparatus of claim 6 wherein the bearing comprises in addition a pair of keyed locating pins of a predetermined size that protrude from the first surface and wherein the bracket includes a keyed opening to receive and lock the bearing.

8. The apparatus of claim 6 wherein the spring is a ratchet spring of a predetermined size.

9. The apparatus of claim 1 wherein the reversing switch comprises in addition:

(a) means for making an electrical connection to the rechargeable electric battery;

(b) a first housing adapted to receive the means for making an electrical connection to the rechargeable electric battery;

(c) means for connecting the electric motor to the means for making an electrical connection so as to apply an electric voltage to the electric motor;

(d) means for reversing a direction of the electrical connection so as to cause a reversal of a direction of rotation of the electric motor, the means for reversing connected to and operated by the slide;

(e) a second housing adapted to receive and contain the means ror making an electrical connection with the electric motor, the second housing in conjunction with the first housing adapted to receive the means for reversing the direction of operation of the electric motor; and (f) means for securing the first housing to the second housing in a snap fit.

10. The apparatus of claim 9 wherein the means for engaging the rechargeable electric battery comprises in combination:

(a) a conductive wire of a predetermined length having a first end and a second end opposite the first end, the second end having a first conductive terminal contact connected to it to enable electrical connection to the rechargeable battery;

(b) a conductive connector plate connected to the first end of the conductive wire, the connector plate having a first end comprising a negative charger terminal contact and a second end opposite the first end; and (c) a second conductive terminal contact having a first end comprising a positive charger terminal and a second end opposite the first end, the second contact having a plurality of positive contact segments and an elongated battery contact segment.

11. The apparatus of claim 9 wherein the means for connecting the electric motor comprises a spring-loaded pushbutton captured within the second housing so as to slide within the second housing, the pushbutton facilitating electrical contact between the electric motor and the rechargeable electric battery to operate the ratchet wrench.

12. The apparatus of claim 9 wherein the means for reversing the direction of rotation of the electric motor comprises in combination:

(a) a pair of conductive switch contacts for reversing the direction of the electric current flowing through the electric motor, the switch contacts disposed in the first housing; and (b) a reversing crank captured between the first housing and the second housing, the reversing crank having a first selector position to operate one of the switch contacts to send electric current to the electric motor in a first direction and a second selector position opposite the first selector position to send electric current to the electric motor in a second direction that is opposite to the first direction when the reversing crank is placed in the second position.

* * * * *